United States Patent [19]

Reck

[11] 4,237,064

[45] Dec. 2, 1980

[54] PROCESS FOR PREPARING QUATERNARY AMMONIUM COMPOSITIONS

[75] Inventor: Richard A. Reck, Hinsdale, Ill.

[73] Assignee: Akzona Incorporated, Asheville, N.C.

[21] Appl. No.: 940,532

[22] Filed: Sep. 8, 1978

[51] Int. Cl.[3] ..... C07C 141/04; C07F 9/09

[52] U.S. Cl. ..... 260/459 A; 260/925; 260/987

[58] Field of Search ..... 260/459 A, 925, 987

[56] References Cited

U.S. PATENT DOCUMENTS

| | | | |
|---|---|---|---|
| 2,847,442 | 8/1958 | Sallmann | 260/459 A |
| 3,624,065 | 11/1971 | Spiess et al. | 260/459 A |
| 3,655,716 | 4/1972 | Leimgruber et al. | 260/459 A |
| 3,663,620 | 5/1972 | Merianos et al. | 260/459 A |
| 3,721,706 | 3/1973 | Hoffmann et al. | 260/459 A |
| 4,000,175 | 12/1976 | Foulletier et al. | 260/459 A |
| 4,009,193 | 2/1977 | Schenermann et al. | 260/459 A |
| 4,076,633 | 2/1978 | Edwards et al. | 252/8.75 |
| 4,139,477 | 2/1979 | Hayek et al. | 252/8.8 |

*Primary Examiner*—Nicky Chan

*Attorney, Agent, or Firm*—Francis W. Young; Robert F. Green

[57] ABSTRACT

A process for preparing certain quaternary ammonium compositions from tertiary amines selected from the group consisting of tertiary amines containing one or two long-chain aliphatic groups, and mixtures thereof, is disclosed. The process comprises reacting the tertiary amine with dimethyl sulfate, diethyl sulfate, or trimethyl phosphate. The reaction is performed in a reaction medium selected from the group consisting of compounds which have a melting point below about 100° C., preferably are capable of dissolving the desired quaternary ammonium compound, and which contain either (i) an ester linkage derived from a fatty acid, (ii) a primary hydroxyl group, or (iii) both, and mixtures of said compounds. The reaction typically is performed at a temperature between about 50° C. and about 150° C., for a length of time sufficient to convert at least a portion of the tertiary amine to the desired quaternary ammonium compound.

21 Claims, No Drawings

PROCESS FOR PREPARING QUATERNARY AMMONIUM COMPOSITIONS

BACKGROUND OF THE INVENTION

This invention relates to a process for preparing certain quaternary ammonium compounds. More particularly, this invention relates to a process for preparing quaternary ammonium methyl sulfate-containing compositions, quaternary ammonium ethyl sulfate-containing compositions, and quaternary ammonium dimethyl phosphate-containing compositions.

It is well known in the art that quaternary ammonium methyl sulfate, quaternary ammonium ethyl sulfate, and quaternary ammonium dimethyl phospate compounds may be prepared by reacting a tertiary amine with the corresponding alkylating agent, dimethyl sulfate, diethyl sulfate, or trimethyl phospate. However, in the prior art procedures for performing such reactions, a reaction medium such as a mixture of isopropyl alcohol and water has been utilized.

It has been recently discovered that quaternary ammonium compounds such as the aforementioned may be utilized in conjunction with "transfer agents", when such quaternary ammonium compounds are utilized for conditioning clothes, such as in an automatic laundry dryer. It has thus been necessary to first prepare the quaternary ammonium compound in a reaction medium such as a mixture of isopropanol and water and then to remove the isopropanol, which would be especially detrimental if the quaternary ammonium compound is utilized in a laundry dryer application. After removal of the isopropanol, the quaternary ammonium compound may then be blended with the transfer agent. It is the purpose of the transfer agent to facilitate the transfer of the quaternary ammonium compound from some release source to the fabrics to be conditioned in the automatic laundry dryer. Also, in some instances, the transfer agents may themselves have some anti-static or softening properties with respect to the fabric to be conditioned.

Typical transfer agents are, for example, glycerol monostearate, sorbitan esters, ethoxylated fatty acids, and nonionic surfactants, generally. The drawback to the prior art procedure for combining the quaternary ammonium compound with the transfer agent is, of course, that a multi-step process is involved. First, the quaternary ammonium compound must be made in a reaction medium, such as isopropanol and water. Secondly, the quaternary-solvent combination must be combined with the transfer agent and then after applying to substrate, the isopropanol and water must be removed.

SUMMARY OF THE INVENTION

The Applicant has now discovered a process for preparing quaternary ammonium methyl sulfate-containing compositions, quaternary ammonium ethyl sulfate-containing compositions, and quaternary ammonium dimethyl phosphate-containing compositions, from a tertiary amine selected from the group consisting of tertiary amines containing 1 or 2 long-chain aliphatic groups, and mixtures thereof. The process comprises reacting said tertiary amine with the corresponding alkylating agent, dimethyl sulfate, diethyl sulfate, or trimethyl phosphate, in a reaction medium selected from the group consisting of compounds which have a melting point from about 0° C. to about 100° C. and contain either (i) an ester linkage derived from a fatty acid, (ii) a primary hydroxyl group, or (iii) both, and mixtures of said compounds. The reaction is performed at a temperature above the melting point of the reaction medium and below the degradation temperature of the desired quaternary ammonium compound. Typically, the reaction is performed at a temperature between about 50° C. and about 150° C., for a length of time sufficient to convert at least a portion of the tertiary amine to the desired quaternary ammonium compound.

DETAILED DESCRIPTION OF THE PREFERRED EMBODIMENTS

As indicated above, the Applicant has discovered a process for preparing a quaternary ammonium compound by reacting the corresponding tertiary amine with an alkylating agent directly in what may be termed a phase transfer agent. This discovery is quite surprising due to the fact that the phase transfer agents contain an ester linkage derived from a fatty acid, a primary hydroxyl group, or both. One skilled in the art would thus necessarily assume that the reactive alkylating agents, dimethyl sulfate, diethyl sulfate, or trimethyl phosphate, would react with the ester linkages or the primary hydroxyl groups to form undesirable by-products, resulting in the formation of little, if any, of the desired quaternary ammonium compounds.

In particular, one skilled in the art would be led to the foregoing conclusion that it would not be possible to directly make such a quaternary ammonium compound in a transfer agent based upon the many prior art references which show, for example, the reaction of dimethyl sulfate with ester linkages and primary hydroxyl groups. For example, one would expect the alkylating agent to react with the free hydroxyl groups by direct etherification to yield methylalkyl ethers. Such alkylation occurs with cellulose as reported in Chem. Abstracts, Volume 43, 396d, and with glucose as reported in Organic Synthesis Collection, Volume 3, Page 800. Thus, one would expect the alkylating agents such as dimethyl sulfate to react with any phase transfer agent, as defined above, which contains free primary hydroxyl groups, by direct etherification, to yield methylalkyl ethers.

Secondly, one skilled in the art would assume that the alkylating agents would react with the primary hydroxyl group through transesterification to yield a variety of products. Such an interaction between dimethyl sulfate and a primary hydroxyl group is discussed in Chem. Abstracts, Volume 41, 1205f, in which reactions between aliphatic alcohols and dimethyl sulfate are shown to yield methylalkyl ethers, dialkyl ethers, and dimethyl ethers. The methylalkyl ethers resulted from direct etherification of the aliphatic alcohol by dimethyl sulfate as discussed above. The dialkyl ethers evidently resulted from transesterification, yielding methanol and a mixture of methylalkyl sulfates and dialkyl sulfates. Subsequently interaction of the methanol and the mixed sulfates yielded the mixed ether products.

Thirdly, it is well known that alkylating agents such as dimethyl sulfate react with esters to give alkyl sulfates by alkyl-interchange. Such a reaction is discussed in E. E. Gilbert, Sulfonation and Related Reactions, Interscience Publishers, page 24 (1965). Additional examples of such alkyl interchange may be found in Chem. Abstracts, Volume 57, 16027 (1962) and Chem. Abstracts, Volume 65, 16848 (1966).

In view of the foregoing prior art which definitely indicates that a strong alkylating agent such as dimethyl sulfate, diethyl sulfate, or trimethyl phosphate, reacts with compounds having an ester linkage or a primary hydroxyl group, one skilled in the art would conclude that the reaction of a tertiary amine with such an alkylating agent could never be performed in the phase transfer agents, discussed above and hereinbelow. The Applicant's discovery that such an alkylation reaction can, in fact, be performed with essentially no reaction between the alkylating agent and the reaction medium occurring, is quite surprising.

REACTION MEDIUM

As indicated above, a rather wide variety of compounds are suitable to function as a reaction medium for the practice of the Applicant's process. Such compounds are also functional to act as phase transfer agents and possibly also as conditioning agents for fabrics. In general, the only criteria which a compound must meet for it to be suitable in the Applicant's process are that the compound has a melting point from about 0° C. to about 100° C. and contains an ester linkage derived from a fatty acid, a primary hydroxyl group, or both. Of course, mixtures of such compounds may be utilized in the practice of the instant invention. Also, the compound may itself contain both an ester linkage as discussed, as well as a hydroxyl group on a primary carbon atom. Generally, it is preferable for the reaction medium to be capable of dissolving the desired quaternary ammonium product at an elevated temperature, such as that at which the quaternization reaction is performed.

The compound which is utilized as the reaction medium should have a melting point below about 100° C., such as from about 0° C., preferably from about 0° C. to about 80° C., most preferably above 38° C., such as from about 38° C. to about 80° C.

If the compound utilized as a reaction medium contains an ester linkage derived from a fatty acid, it is necessary that the fatty acid from which the ester is derived contain from about 8 to about 22 carbon atoms, preferably from about 12 to about 18 carbon atoms. The fatty acid may be either saturated or unsaturated and may be straight chain or branched. Furthermore, the acid may be derived from a natural or a synthetic source. Again, the compound containing the ester linkage preferably is capable of dissolving the desired quaternary ammonium compound.

The alcohol from which the ester is derived is not critical. Preferably, however, the alcohol will be di- or poly- hydric alcohol and will contain from about 2 to about 6 carbon atoms. Exemplary of the useful di- and polyhydric alcohols are propylene glycol; 1,4-butanediol; hexanediol, and sorbitan. Sorbitan is a complex mixture of cyclic anhydroxides of sorbitol as described in U.S. Pat. No. 2,322,821, which is incorporated herein by reference. Preferably, the resulting sorbitan esters correspond to the description of sorbitan esters occurring at Column 13, line 5 through Column 14, line 37, of U.S. Pat. No. 4,076,633. Also, as indicated above, the esters may contain hydroxyl groups, such as primary hydroxyl groups. If di- or polyhydric alcohols are utilized, the esters which are made therefrom will contain a free hydroxyl group.

Any free hydroxyl group on any of the esters useful in the practice of the present process, as well as the free primary hydroxyl group on any of the alcohols, may be reacted with from hydroxyl group is a hydroxyl group attached to a primary carbon atom which is simply a carbon atom which is bonded to only one other carbon atom. A hydroxyl group is simply an —OH function, not part of an acid group. The compound may be a relatively simple aliphatic alcohol containing from about 8 to about 22 carbon atoms. However, the compound containing the primary hydroxyl group may be much more complex, such as ethylene oxide and/or propylene oxide condensates such as the compositions marketed by BASF Wyandotte under the trademark Pluronic. Also, other examples of more complex compounds containing primary hydroxyl groups include polyethoxylated amides, polyethoxylated alcohols, and polyethoxylated alkylated phenols. The foregoing will be discussed in more detail hereinbelow.

Without limiting the broad range of compounds which may be used as reaction media for the practice of the present process, the following classes of compounds are suitable for use in the instant process, provided that such compounds meet the criteria with respect to for example, melting point, as indicated hereinabove: Sorbitan esters, ethoxylated sorbitan esters, polyoxypropylene glycol, polyoxyethylene glycol esters (ethoxylated fatty acids), monoglycerides, ethoxylated monoglycerides, ethylene oxide condensates, propylene oxide condensates, ethylene oxide/propylene oxide block and random condensates, polyethoxylated amides, polyethoxylated alcohols, and polyethoxylated alkylated phenols.

Polyoxyethylene glycol esters (ethoxylated fatty acids) and polyoxypropylene glycol esters which are useful in the practice of the present invention include compounds of the following formula:

$$R-\overset{O}{\overset{\|}{C}}\,[O-CH_2)_b]_a\,OH$$

wherein a has a value from about 2 to about 10, preferably from about 5 to about 6 and b is an integer from 2 to 3. In this and the following formulae, R represents an aliphatic group containing from about 8 to about 22, preferably from about 12 to about 18 carbon atoms. The aliphatic group may be saturated or unsaturated and may contain branching.

The monoglycerides which are useful in the practice of the present invention include compounds of the following formula:

$$R-\overset{O}{\overset{\|}{C}}-O-CH_2-\underset{\underset{OH}{|}}{CH}-CH_2\,OH$$

The foregoing monoglycerides may be ethoxylated to form ethoxylated monoglycerides which are useful in the practice of the present process. Preferably, the ethoxylated monoglycerides include compounds containing from about 2 to about 10 ethylene oxide groups, most preferably from about 5 to about 6 ethylene oxide groups.

The polyethoxylated amides which are useful in the practice of the present process include compounds of the following formula:

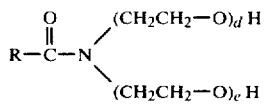

wherein d and e independently are integers totalling from about 2 to about 10, preferably from about 5 to about 6.

The alcohols which are useful in the practice of the present invention include compounds of the following formula:

$$R-OH$$

As indicated, the hydroxyl group may be reacted with from about 1 to about 10 moles, preferably from about 5 to about 6 moles, of ethylene oxide, propylene oxide, or a combination thereof.

It is apparent from the foregoing that it is impossible to specifically delineate all of the useful compounds which may be employed as the reaction medium of the present invention. However, by reference to the parameters set forth hereinabove, one skilled in the art may select an appropriate compound for such use.

TERTIARY AMINE

As discussed above, the tertiary amine useful in the practice of the instant process may be selected from the group consisting of tertiary amines containing 1 or 2 long-chain aliphatic groups. The term "long-chain aliphatic group" means a saturated or unsaturated, straight chain or branched chain aliphatic group (alkyl or alkenyl) having from about 8 to about 22 carbon atoms. Preferably, the long-chain aliphatic group contains from about 12 to about 18 carbon atoms. The nature of the amine is not critical to the invention, so long as it contains one or two long chain aliphatic groups. The remaining constituent(s) on the nitrogen atom may be, for example, aliphatic groups containing from 1 to about 4 carbon atoms. The aliphatic group may be substituted or unsubstituted. Also the remaining constituent(s) may be an ethylene oxide and/or propylene oxide condensate containing from about 1 to about 5 moles of ethylene oxide and propylene oxide, total.

Of course, mixtures of such tertiary amines may be employed in the practice of the instant invention. Although any such tertiary amines corresponding to the above criteria may be utilized, generally, such tertiary amines will correspond to the formula:

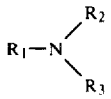

wherein $R_1$ is selected from the group consisting of saturated or unsaturated, straight or branched chain, aliphatic groups, containing from about 8 to about 22 carbon atoms, preferably from about 12 to about 18 carbon atoms, $R_2$ is selected from the group consisting of saturated or unsaturated, straight or branched chain, aliphatic groups containing from about 8 to about 22 carbon atoms, preferably from about 12 to about 18 carbon atoms, short-chain alkyl groups containing from about 1 to about 4 carbon atoms, hydroxyethyl, hydroxypropyl, $(CH_2CH_2O)_g$ $CH_2CH_2OH$, and $(C_3H_6O)_g$ $C_3H_6OH$, wherein g is an integer from 0 to 5, and R is selected from the group consisting of short-chain alkyl groups containing from about 1 to about 4 carbon atoms, hydroxyethyl, hydroxypropyl, $(CH_2CH_2O)_h$ $CH_2CH_2OH$ and $(C_3H_6OH$, wherein h is an integer from 0 to 5.

From the foregoing it is quite apparent that it is impossible to explicitly indicate every possible tertiary amine compound which may be utilized in the practice of the instant invention. However, by referring to the foregoing parameters, one skilled in the art may readily select an appropriate tertiary amine compound for use in performing the instant process.

It should be noted that in many instances the tertiary amine may contain some impurities such as primary and secondary amine as well as tri(long-chain aliphatic)amine. Preferably, the amine contains less than one percent (1%) of primary and secondary amine and less than about 10% of tri(long-chain aliphatic)amine, most preferably less than about 5% of tri(long-chain aliphatic)amine.

REACTION CONDITIONS

In performing the instant process, no special reaction conditions are necessary, and typical conditions for performing quaternization reactions may be employed. Thus, the temperature employed is not critical, but may vary over a wide range. The temperature should be above the melting point of the reaction medium and below the degredation temperature of the desired quaternary ammonium products. However, it is generally preferable to utilize a temperature within the range from about 50° to about 150° C., preferably from about 70° C. to about 100° C. Of course, temperatures outside of the foregoing range may be utilized, depending upon the particular reactants involved as well as the particular reaction medium. The quaternization reaction may be performed for any length of time, so long as it is sufficient to convert at least some portion of the tertiary amine into the desired quaternary ammonium compound. In some instances, it may be desirable to have a resultant composition containing a mixture of both the quaternized amine and the tertiary amine. Thus, the degree of quaternization may range from about 1 to about 100%, but most typically quaternization will be desired in the range of about 90 to about 100% based upon the originally present tertiary amine compound. However, no free dimethyl sulfate should be left at the conclusion of the reaction.

The tertiary amine may be added directly to the reaction medium. For many reasons, such a direct addition is desirable. However it is, of course, possible to add a secondary amine to the reaction medium and to convert the secondary amine it situ into the tertiary amine prior to its quaternization.

A typical procedure for preparing a quaternary ammonium compound such as dimethyl di-(hydrogenated tallow)ammonium methyl sulfate in an ester reaction medium would be to charge a reactor with a quantity of tertiary amine, such as 5 gallons. The tertiary amine contains preferably less than 1.0% of primary and secondary amine. After the reactor is charged with the tertiary amine, an amount of ester is charged in accordance with the following equation in which NE stands for nitrogen equivalent:

Pounds of Ester =

-continued $$\left(\frac{\text{Pounds of Tertiary Amine}}{\text{NE of Tertiary Amine}}\right)\left(\begin{matrix}126.1 + \text{NE of}\\ \text{Tertiary}\\ \text{Amine}\end{matrix}\right)\left(\frac{3}{7}\right)$$

The foregoing equation will provide for the production of the desired methyl sulfate quaternary ammonium compound as a 70% active (weight:weight) composition. After the reactor is charged with the tertiary amine and the ester, the contents should be heated to a suitable temperature, such as 80° C., and agitation commenced. Subsequently, a quantity of dimethyl sulfate, containing no more than 0.2% acid, (as $H_2SO_4$) should be charged according to the following equation:

$$\text{Pounds of Dimethylsulfate} = \frac{\text{Pounds of Tertiary Amine}}{\text{NE of Tertiary Amine}} \times 122.78$$

The foregoing equation should allow for the production of 1.5%, by weight, of free amine after completion of the reaction. An exothermic reaction will occur during the addition of the dimethyl sulfate. The reaction should be performed in a temperature range from about 80° C. to about 100° C. After completion of the reaction, the contents may be cooled and recovered.

Another procedure for the production of a quaternary ammonium compound such as bis(2-hydroxyethyl)methyloctadecylammonium methyl sulfate in an ethoxylated fatty alcohol (polyoxyethlene glycol ester), would be as follows: The tertiary amine containing less than 2.0% of primary and secondary amine should be charged to a reactor. For example, 3 to 4 gallons of the tertiary amine may be charged. Subsequently, the reactor may be charged an with an amount of ethoxylated fatty alcohol, such as polyoxyethylene (5) glycol octadecandate, in accordance with the following equation:

$$\text{Pounds of Ethoxylated Fatty Alcohol} = \left(\frac{\text{Pounds of Tertiary Amine}}{\text{NE of Tertiary Amine}}\right)\left(\begin{matrix}126.1 + \text{NE}\\ \text{Tertiary}\\ \text{Amine}\end{matrix}\right)$$

Subsequently, the reactor content may be heated to a temperature such as 100° C., and agitation commenced. Dimethyl sulfate containing no more that 0.2% acid, (as $H_2SO_4$), may then be charged to the reactor. The amount of dimethyl sulfate to be charged may be determined in accordance with the following equation:

$$\text{Pounds of Dimethylsulfate} = \frac{\text{Pounds of Tertiary Amine}}{\text{NE of Tertiary Amine}} \times 121.04$$

The weight of the dimethyl sulfate charged in accordance with the foregoing equation should give approximately 1.5%, by weight, free amine after completion of the reaction. An exothermic reaction will occur and the temperature of the reaction should be carried to about 115° to 130° C., and the rate of dimethyl sulfate addition should be controlled so that a temperature within the foregoing range is maintained. After completion of the reaction, the contents may be cooled and recovered.

Further understanding of the instant process may be obtained by reference to the following non-limiting examples:

EXAMPLE I

Preparation of Dimethylde(hydrogenerated tallow)ammonium Methyl Sulfate in Sorbitan Monostearate To a ten-gallon autoclave fitted with a weighed dimethyl sulfate reservoir there were added 28 pounds of methyldi(hydrogenated tallow)amine and 14.9 pounds of sorbitan monostearate (SMAZ 60, Mazer Chemicals, Inc.). The mixture was heated with agitation to 75° C. and 6.36 pounds of dimethyl sulfate added as the temperature rose immediately to 108° C. Sodium hydroxide (0.66 pounds of 30% aqueous) was then added.

The reaction mixture, 48.5 pounds, was recovered and analyzed as 66.2% quaternary, 1.5% amine, and 1.0% amine methyl sulfate, and had a Gardner color of 4–5, 0.7% ash, 1.2% water, and a pH of 4.9.

EXAMPLE II

Preparation of Dimethyldi(hydrogenated tallow)ammonium Methyl Sulfate in Glycerol Monostearate To 28.4 pounds of methyl di(hydrogenated tallow)amine in a ten-gallon autoclave fitted with a weighed dimethylsulfate reservoir there was added three pounds of glycerol monostearate. The mixture was heated with agitation to 70° C. followed by an addition of 6.44 pounds of dimethyl sulfate. The temperature of the reaction mixture rose to 120° C. Glycerol monostearate, 11.5 pounds, and 0.35 pounds of methyldi(hydrogenated tallow)amine was again added and the reaction mixture allowed to cool with agitation to room temperature. A sample of the final mixture was analyzed as 69.1% quaternary, 1.6% amine, and 2.7% amine sulfate, and had a Gardner color of 4–5, nil ash, 0.2% water, and a pH of 3.9.

EXAMPLE III

Preparation of Dimethyldi(hydrogenated tallow)ammonium Methyl Sulfate in Polyoxyethylene(5)Glycol Octadecanoate To 28 pounds of methyldi(hydrogenated tallow)amine in a ten-gallon autoclave fitted with a weighed dimethylsulfate reservoir there was added 3 pounds of polyoxyethylene(5)glycol octadecanoate. The mixture was heated to 95° C. and 6.49 pounds of dimethylsulfate added, which increased the temperature to 130° C. Then, 11.8 pounds of polyoxyethylene(5)glycol octadecanoate was again added as the reaction mixture was allowed to cool. A sample of this mixture was analyzed as 67.9% quaternary, 1.5% amine, and 1.8% aminemethylsulfate, and had a Gardner color of 4–5, 0.07% ash, 0.1% water and a pH of 6.6.

EXAMPLE IV

Preparation of Dimethyldi(hydrogenated tallow)ammonium Methyl Sulfate in Sorbitan Monooleate To 250 g (0.477 gmol) of methyldi(hydrogenated tallow) amine, in 133 g of sorbitan monooleate, (SMAZ 80, Mazer Chemicals, Inc.), heated to 48° C. with stirring in a 1-liter, 3-neck glass round-bottom flask, there was added all at once 58.6 g (0.464 gmol) of dimethylsulfate. The temperature immediately rose to 99° C.; the heat was removed and the reaction mixture allowed to cool to about 65°–70° C. at which solidification began.

A sample of the reaction mixture analyzed as 66% quaternary, 1.6% amine, and 3.2% amine methylsulfate, and had a Gardner color of 3.

EXAMPLE V

Preparation of Methylbis(2-hydroxyethyl)octadecyl Ammonium Methyl Sulfate in Polyoxyethylene(5)glycoloctadecanoate To 150 g (0.418 gmol) of bis(2-hydroxyethyl)octadecylamine in 203 g of polyoxyethylene(5)glycoloctadecanoate heated to 75° C. with stirring in a 1-liter, 3-neck glass round-bottom flask fitted with a thermometer and electric heating mantle there was added 51.1 g (0.405 gmol) of dimethyl sulfate (Aldrich, 99%). The temperature rose immediately to 120° C.; the heat was removed and the reaction mixture allowed to cool to 35°–40° C. at which solidification began to occur. A sample of the mixture analyzed as 48% quaternary, 2.16% amine methylsulfate and 1.67% amine and amine soap, calculated as amine.

What is claimed is:

1. A process for preparing a quaternary ammonium methylsulfate-containing composition from a tertiary amine selected from the group consisting of tertiary ammonium compounds containing one or two long-chain aliphatic groups, and mixtures thereof, comprising reacting said tertiary amine with dimethyl sulfate, (a) in a reaction medium selected from the group consisting of compounds which have a melting point from about 0° C. to about 100° C., and which contain an ester linkage derived from a fatty acid which contains from about 8 to about 22 carbon atoms and a di- or polyhydric alcohol which contains from about 2 to about 6 carbon atoms, (b) at a temperature above the melting point of the reaction medium and below the degradation temperature of the desired quaternary ammonium methyl sulfate;

(c) for a length of time sufficient to convert at least a portion of the tertiary amine to the desired quaternary ammonium methylsulfate.

2. A process for preparing a quaternary ammonium ethylsulfate-containing composition from a tertiary amine selected from the group consisting of tertiary ammonium compounds containing one or two long-chain aliphatic groups, and mixtures thereof, comprising reacting said tertiary amine with diethyl sulfate, (a) in a reaction medium selected from the group consisting of compounds which have a melting point from about 0° C. to about 100° C., and which contain an ester linkage derived from a fatty acid which contains from about 8 to about 22 carbon atoms and a di- or polyhydric alcohol which contains from about 2 to about 6 carbon atoms, (b) at a temperature above the melting point of the reaction medium and below the degradation temperature of the desired quaternary ammonium ethyl sulfate;

(c) for a length of time sufficient to convert at least a portion of the tertiary amine to the desired quaternary ammonium ethyl sulfate.

3. A process for preparing a quaternary ammonium dimethyl phosphate-containing composition from a tertiary amine selected from the group consisting of tertiary ammonium compounds containing one or two long-chain aliphatic groups, and mixtures thereof, comprising reacting said tertiary amine with trimethyl phosphate, (a) in a reaction medium selected from the group consisting of compounds which have a melting point from about 0° C. to about 100° C., and which contain an ester linkage derived from a fatty acid which contains from about 8 to about 22 carbon atoms and a di- or polyhydric alcohol which contains from about 2 to about 6 carbon atoms, (b) at a temperature above the melting point of the reaction medium and below the degradation temperature of the desired quaternary ammonium dimethyl phosphate;

(c) for a length of time sufficient to convert at least a portion of the tertiary amine to the desired quaternary ammonium dimethyl phosphate.

4. The process of claim 1, 2, or 3 in which the tertiary amine contains one long-chain aliphatic group containing from about 8 to about 22 carbon atoms and two members independently selected from the group consisting of aliphatic groups containing from 1 to about 4 carbon atoms, and condensates of ethylene oxide, propylene oxide, and mixtures thereof containing from about 1 to about 5 moles of ethylene oxide, propylene oxide, or a mixture thereof.

5. The process of claim 1, 2, or 3 wherein the tertiary amine has the formula:

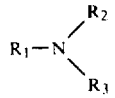

wherein $R_1$ is selected from the group consisting of aliphatic groups, containing from about 8 to about 22 carbon atoms, $R_2$ is selected from the group consisting of aliphatic groups containing from about 8 to about 22 carbons atoms, short-chain alkyl groups containing from about 1 to about 4 carbon atoms, $(CH_2CH_2O)_g CH_2CH_2OH$, and $(C_3H_6O)_g C_3H_6OH$, wherein g is an integer from 0 to 5, and $R_3$ is selected from the group consisting of short-chain alkyl groups containing from about 1 to about 4 carbon atoms, $(CH_2CH_2O)_h CH_2CH_2OH$ and $(C_3H_6O)_h C_3H_6OH$, wherein h is an integer from 0 to 5.

6. The process of claim 1, 2 or 3 wherein the process is performed at a temperature from about 50° C. to about 150° C.

7. The process of claim 6 wherein the reaction medium is a compound which contains both an ester linkage and a primary hydroxyl group.

8. The process of claim 6 wherein the reaction medium is capable of dissolving the quaternary ammonium compound at an elevated temperature.

9. The process of claim 8 wherein the elevated temperature is the temperature at which the quaternization is performed.

10. The process of claim 6 in which the reaction medium has a melting point from about 0° C. to about 80° C.

11. The process of claim 6 in which the reaction medium has a melting point from about 38° C. to about 80° C.

12. The process of claim 6 in which the reaction medium is a compound which contains an ester linkage derived from a fatty acid which contains from about 12 to about 18 carbon atoms.

13. The process of claim 6 in which the reaction medium is a compound which contains an ester linkage derived from an alcohol selected from the group consisting of propylene glycol, 1,4-butanediol, hexanediol, and sorbitans.

14. The process of claim 6 in which the reaction medium is a compound which contains an ester linkage and a primary hydroxyl group which has been reacted with from about 1 to about 10 moles of ethylene oxide, propylene oxide, or a mixture thereof.

15. The process of claim 6 in which the primary hydroxyl group has been reacted with from about 5 to about 6 moles of ethylene oxide, propylene oxide, or a mixture thereof.

16. The process of claim 6 wherein the reaction medium is selected from the group consisting of sorbitan esters, ethoxylated sorbitan esters, polyoxypropylene glycol, polyoxyethylene glycol esters (ethoxylated fatty acids), monoglycerides, ethoxylated monoglycerides, ethylene oxide condensates, propylene oxide condensates, ethylene oxide/propylene oxide block and random condensates, polyethoxylated amides, polyethoxylated alcohols, and polyethoxylated alkylated phenols.

17. The process of claim 6 in which the reaction medium is an ester of the formula:

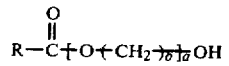

wherein a is an integer from about 2 to about 10, b is an integer from 2 to 3, and R is an aliphatic group containing from about 8 to about 22 carbon atoms.

18. The process of claim 17 in which a is an integer from about 5 to about 6 and R contains from about 12 to about 18 carbon atoms.

19. The process of claim 6 wherein the reaction medium is a compound of the formula:

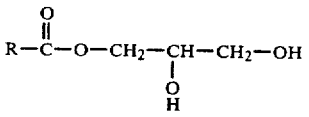

wherein R is an aliphatic group containing from about 8 to about 22 carbon atoms.

20. The process of claim 19 wherein R contains from about 12 to about 18 carbon atoms.

21. The process of claim 20 wherein the compound has been ethoxylated with from about 2 to about 10 moles of ethylene oxide.

* * * * *